United States Patent [19]

Bourg

[11] Patent Number: 4,705,111

[45] Date of Patent: Nov. 10, 1987

[54] TUBING ASSEMBLY

[75] Inventor: Robert A. Bourg, Lafayette, La.

[73] Assignee: Amoco Corporation, Chicago, Ill.

[21] Appl. No.: 896,996

[22] Filed: Aug. 15, 1986

[51] Int. Cl.[4] ..... E21B 29/10

[52] U.S. Cl. ..... 166/277; 166/114; 166/380

[58] Field of Search ..... 166/378, 380, 114–116, 166/242, 277, 313, 113, 143, 180, 191, 243, 98, 99, 54.1; 285/24, 27, 15; 294/86.26, 86.34

[56] References Cited

U.S. PATENT DOCUMENTS

| | | | |
|---|---|---|---|
| 2,495,352 | 1/1950 | Smith | 166/277 |
| 2,643,722 | 6/1953 | Lynes et al. | 166/187 |
| 2,935,131 | 5/1960 | McCune | 166/114 |
| 3,083,767 | 4/1963 | Brown | 294/86.34 |
| 3,170,518 | 2/1965 | Brown | 166/313 |
| 3,409,085 | 11/1968 | Oliver | 166/138 |
| 3,420,304 | 1/1969 | Kilgore | 166/114 |
| 3,727,967 | 4/1973 | Anastasiu et al. | 294/86.31 |
| 3,895,678 | 7/1975 | Wright et al. | 166/242 X |
| 4,403,654 | 9/1983 | Haynes | 166/313 X |

FOREIGN PATENT DOCUMENTS

| | | | |
|---|---|---|---|
| 641071 | 1/1979 | U.S.S.R. | 166/99 |
| 713983 | 2/1980 | U.S.S.R. | 294/86.26 |

*Primary Examiner*—James A. Leppink
*Assistant Examiner*—Hoang C. Dang
*Attorney, Agent, or Firm*—Scott H. Brown; Fred E. Hook

[57] ABSTRACT

A tubing assembly is disclosed for providing fluid communication and wireline access from a tubing string through a tubing remnant extending above a packer set within a casing. In combination, the tubing assembly comprises a funnel guide connectable to the lower portion of the tubing string, and a packer connectable with the tubing string above the funnel guide for establishing a sealed zone within the casing extending from above the funnel guide to the tubing remnant packer. The funnel guide further comprises a body having a lower flared skirt adapted to receive thereinto an upper portion of the tubing remnant, a central bore extending through the body, and devices on an upper portion thereof for connection to the tubing string.

5 Claims, 2 Drawing Figures

TUBING ASSEMBLY

BACKGROUND OF THE INVENTION

1. Field of the Invention

The present invention provides a tubing assembly for providing fluid communication through a tubing string into a tubing remnant extending above a packer set within a casing, and more particularly, to such a tubing assembly that includes a funnel guide and a packer connectible to the tubing string.

2. Setting of the Invention

In the production of oil and gas, production tubing is usually set via tubing hangers and packers within a casing to provide a fluid communication from one or more hydrocarbon bearing formations to the surface. Oftentimes, the production tubing needs to be replaced because of temperature, sand, and corrosion damage; however, for various reasons, the production packer cannot be removed. In this case, where the production tubing and packer cannot be removed, workover equipment is brought to the wellsite, and the packer is milled out and the existing tubing is removed. The milling operation is expensive and time consuming, and is to be avoided if possible. If the production tubing is to be removed and the packer cannot be removed, another operation is to cut the production tubing, using an electric line or mechanical devices, above the production packer eliminating the need to remove the packer and any production equipment extending therebelow.

Once the production tubing has been cut to create a tubing remnant that extends a certain distance above the packer, an "overshot", which is usually in the form of a scooped entry guide, is attached to the lower end of a tubing string, and is lowered into contact with the tubing remnant. Conventional overshots contain internal O-rings or other internal sealing devices to establish the needed fluidic seal around the tubing remnant so that produced fluids do not pass to the surface in the casing annulus. Problems arise with using these overshots because the mechanical or electric line cuts of the old tubing string often leave jagged edges such that the internal sealing mechanisms are damaged or destroyed by the lowering of the scooped entry guide onto the tubing remnant. Further, it has been found that the O-rings which are usually made of rubber can be damaged or caused to fail by corrosive fluids, such as $H_2S$ and $CO_2$, that are within the produced fluids.

Another problem associated with the use of conventional overshots is that an overshot connects and attaches to the tubing remnant by way of slips, grapples, and the like, which can be a cumbersome and time consuming procedure. Also, the fluidic seal is maintained and the attachment maintained by downward pressure of the tubing string which could buckle the the tubing remnant.

There exists a need for a simple assembly and method of use for connecting a tubing string to a tubing remnant that cannot be damaged by any jagged edges on the tubing remnant or action of the produced fluids, and which does not require connection and attachment to the tubing remnant.

BRIEF SUMMARY OF THE INVENTION

The present invention provides a tubing assembly for providing fluid communication and wireline access from a tubing string through a tubing remnant, which extends above a packer set within a casing. The tubing assembly is contemplated to overcome the foregoing deficiencies and meet the above described needs. In combination, the tubing assembly comprises a funnel guide attachable to a lower portion of the tubing string, and a packer connected to the tubing string above the funnel guide for establishing a sealed zone within the casing extending from above the funnel guide to the tubing remnant packer. The funnel guide comprises a body having a lower flared skirt adapted to receive thereinto an upper portion of the tubing remnant, a central bore extending through the body, and connection devices on an upper portion of the body for connection to a lower end of the suspended tubing string.

The packer, which can be actuated by hydraulic pressure or by vertical movement of the tubing string, is attached to the tubing string adjacent the lower end thereof and the funnel guide is connected to the lower end of the tubing string. The tubing string is then lowered into the casing until an upper portion of the tubing remnant is received into the lower portion of the funnel guide. Thereafter, the packer is actuated to establish the sealed zone within the casing extending from the packer above the funnel guide to the tubing remnant packer. In this manner the needed fluidic seal is created, not directly around the tubing remnant as in the past by O-rings and the like and not by direct connection and attachment, but by setting the packer above the funnel guide. In this manner the simple, rugged tubing assembly can be used to connect to a tubing remnant to provide fluid communication and wireline access from a tubing string through the tubing remnant.

DETAILED DESCRIPTION OF THE EMBODIMENTS

A tubing assembly is disclosed herein for providing fluid communication and wireline access from a tubing string through a tubing remnant extending above a packer set within a casing. In combination, the tubing assembly comprises a funnel guide attachable to a lower portion of the tubing string, and a packer connectible to the tubing string above the funnel guide for establishing a sealed zone within the casing extending from above the funnel guide to the tubing remnant packer. The funnel guide further comprises a body having a lower flared skirt adapted to receive thereinto an upper portion of the tubing remnant, a central bore extending through the body, and devices on an upper portion for connection to the tubing string.

Figure 1:
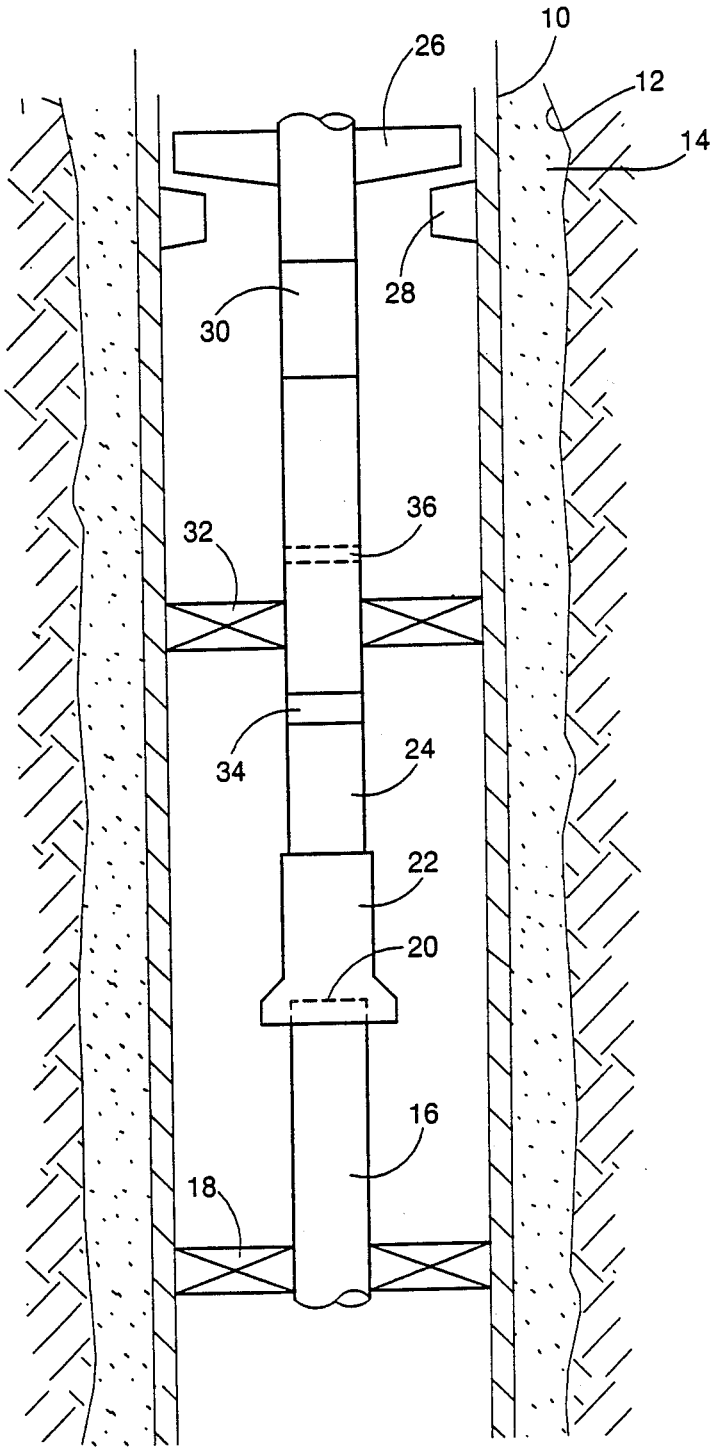
FIG. 1 is an elevational view of a tubing string suspended within a casing, including on a lower end thereof a funnel guide, embodying the present invention landed over a tubing remnant.

As shown in FIG. 1, a well casing 10 is set in a wellbore 12 within a column of cement 14, as is well-known to those skilled in the art. A tubing string 16 is suspended within the casing 10 and extends a certain distance above a production packer 18 that prevents any fluid from passing through the annulus between the casing 10 and the tubing remnant 16. An upper portion of the tubing string 16 forms a tubing remnant 20 after being cut by an electric line or by mechanical devices. The tubing remnant 20 is received into a funnel guide 22, which will be described in more detail below, that is connected to a lower portion of a tubing string 24 extending upwards through the casing 10 to the surface, as is well-known to those skilled in the art.

Connectable in series with the tubing string 24 is a tubing hanger 26 cooperable with casing shoulders 28 extending outwardly from the casing 10, allowing the tubing string 24 to be suspended within the casing 10, as is well-known to those skilled in the art. Also connected in series within the tubing string 24 can be a surface controlled subsurface safety valve 30 or a gas lift mandrel (not shown).

A conventional downhole packer 32 is connectable to the tubing string 24 above the funnel guide 22 and can be actuated to form a hydraulic seal between the casing 10 and the tubing string 24 by any conventionally known manner, such as by vertical movement of the tubing string 24. Also, the packer 32 can be actuated by the application of hydraulic pressure through the internal bore of the tubing string 24 and outwards through a bypass nipple 34, connectable within the tubing string 24 below the packer 32, again as is well-known to those skilled in the art. If desired, a slip joint or expansion joint 36 can be connected in series with the tubing string 24 either above or below the packer 32 to provide for relative vertical movement of the tubing string 24 caused by the thermal expansion of the tubing vs the casing caused by the production of high temperature fluids through the tubing string 24.

Figure 2:
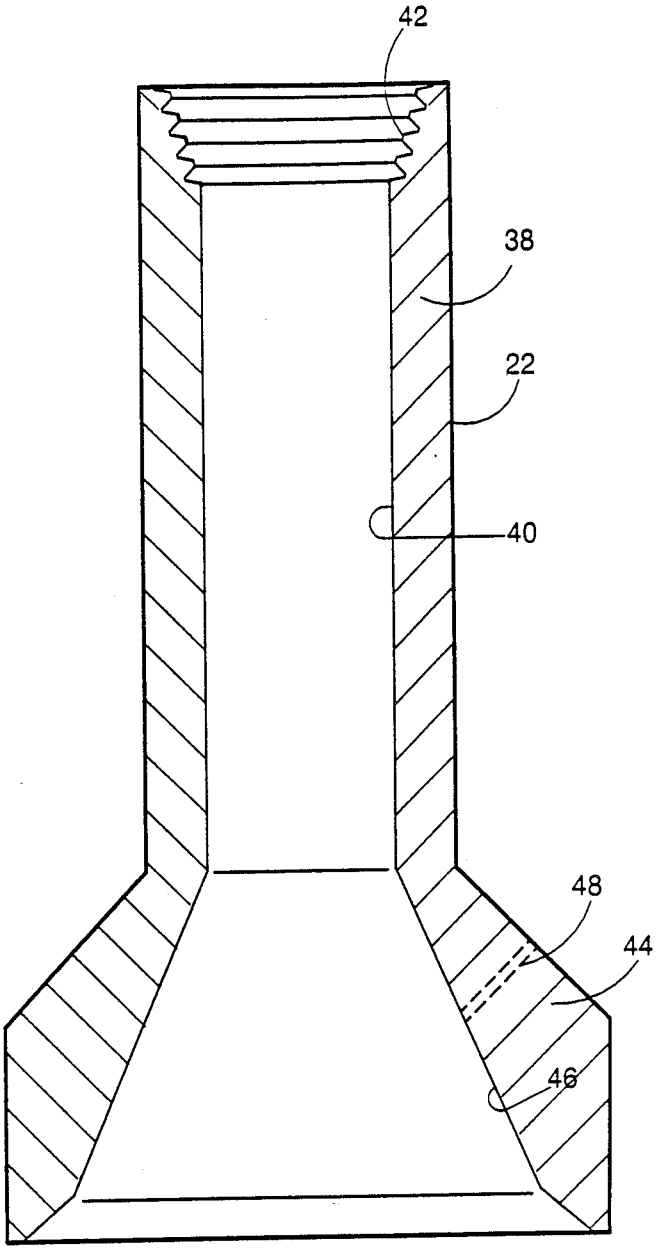
FIG. 2 is a cut-away elevational view of one embodiment of a funnel guide embodying the present invention.

As shown in FIG. 2, the funnel guide 22 comprises an elongated tubular barrel or body 38 having an internal bore 40 extending there through. The upper portion of the tubular body 38 includes threaded connections 42 cooperable with threaded connections (not shown) on a lower end of the tubing string 24. Other connection devices, such as a J-slot or a bayonet mount, can be utilized in place of the threaded connection 42 as desired. A lower portion of the funnel guide 22 includes a flared guide skirt 44, which can be formed as part of the body 38 or can be connected to a lower portion of the body 38 by welding or threaded connections, as may be desired. The flared skirt 44 also includes an internal coaxial flared opening 46 to provide guided entry for the upper portion of the tubing remnant 20 to be received thereinto. At least one fluid bypass port extends through the flared skirt 44 to provide fluid access from the flared opening 46 to the exterior of the flared skirt 44. The ports 48 can be circumferentially spaced around the flared skirt 44 as desired. The purpose of these flow-by ports 48 is to permit fluid to escape as the flared skirt 22 is placed over the damaged or cut tubing remnant 16 to prevent any fluid pressure buildup. The fluid bypass ports are preferred, but not mandatory.

Now that the individual elements of the present invention have been described, the method of utilizing these elements will be described below. After the tubing remnant 20 has been created by removing the old tubing string from above the packer 18, tubing equipment is connected in series to the tubing string 24, as desired. In one form, the tubing string 24 would include the packer 32, the bypass nipple 34 (if the packer 32 is to be actuated by fluid pressure), and the funnel guide 22. After the packer 32 and the funnel guide 22 have been connected to the tubing string 24, the tubing string 24 is lowered through the casing 10 until the upper portion of the tubing remnant 20 is received into the flared opening 46 of the flared skirt 44. It should be noted that the flared opening 46 of the flared skirt 44 does not include any sealing devices, such as O-rings and the like, and does not include any connection devices, such as slips, grapples, and the like for connection and attachment to the tubing remnant 20.

Once the upper portion of the tubing remnant 20 is received into the flared opening 46 of the flared skirt 44, a wireline gauge can be lowered through the tubing string 24 to determine that there is direct fluid communication and wireline access from the tubing string 24 into and through the tubing remnant 20. Thereafter, if desired, wireline tools can be run into the production tubing 16 extending below the packer 18. Then, the tubing string 24 can be raised and lowered a predetermined distance to set the packer 32, as well-known to those skilled in the art. Preferably, a fluid pressure test tool (not shown) is lowered on a wireline through the tubing string 24 and landed opposite the nipple 34, and hydraulic pressure is applied through the tubing string 24 and out the nipple 34 to set the packer 32 to create the sealed zone within the casing 10 extending from the packer 32 to the production packer 18. After the packer 32 has been set, then the tubing hanger 26 can be set, as is well-known to those skilled in the art to suspend the tubing string 24 and not buckle or damage the tubing remnant 20.

By use of the present invention, a simple method of establishing fluid communication and wireline access from a tubing string through a tubing remnant is provided without the need for direct connection to the tubing remnant. Further, a fluid seal is created by the use of a conventional packer, which does not require easily destroyed sealing devices.

Wherein, the present invention has been described in particular relation to the drawings attached hereto, other and further modifications, apart from those shown or suggested herein, may be made within the scope and spirit of the present invention.

What is claimed is:

1. A method for providing fluid communication and wireline access from a tubing string through a damaged or cut tubing remnant extending above an existing packer set within a casing, comprising:
   (a) cutting the tubing extending above the existing packer in the casing;
   (b) connecting a packer to the tubing string adjacent the lower end thereof;
   (c) connecting a funnel guide to the lower end of the tubing string;
   (d) lowering the tubing string with the packer and the funnel guide into the casing until an upper portion of the damaged or cut tubing remnant is received into a lower portion of the funnel guide; and
   (e) actuating the packer to establish a sealed zone within the casing extending from the packer above the funnel guide to the tubing remnant packer.

2. The method of claim 1 wherein the funnel guide comprises a body having a lower flared skirt adapted to receive an upper portion of the tubing remnant thereinto, a central bore extending through the body, and means on the upper portion thereof for connection to the tubing string.

3. The method of claim 1 wherein the packer is actuated by vertical movement of the tubing string.

4. The method of claim 1 wherein the packer is actuated by application of hydraulic pressure.

5. The method of claim 1 and including the step of preventing the downward movement of the tubing string by setting the tubing string within a tubing hanger above the packer.

* * * * *